US008443974B2

(12) United States Patent
Oh

(10) Patent No.: US 8,443,974 B2
(45) Date of Patent: May 21, 2013

(54) ROLLED MEMORY FOAM BEDDING ARTICLE HAVING A PLURALITY OF ROLL PORTIONS

(75) Inventor: Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 1377 days.

(21) Appl. No.: 11/786,854

(22) Filed: Apr. 13, 2007

(65) Prior Publication Data

US 2007/0245490 A1 Oct. 25, 2007

Related U.S. Application Data

(60) Provisional application No. 60/903,204, filed on Feb. 22, 2007.

(30) Foreign Application Priority Data

Apr. 19, 2006 (CN) ..... 2006 1 0035156

(51) Int. Cl.
*B65D 85/00* (2006.01)

(52) U.S. Cl.
USPC ..... 206/389; 206/223; 206/394; 206/391

(58) Field of Classification Search ..... 206/394, 206/391, 392, 393, 459.1, 459.5, 407, 408, 206/389, 390; 108/55.1; 242/160.2, 160.4
See application file for complete search history.

(56) References Cited

U.S. PATENT DOCUMENTS

| | | | | |
|---|---|---|---|---|
| 3,174,163 | A * | 3/1965 | Gibson | 5/640 |
| 3,290,704 | A * | 12/1966 | Willis | 5/636 |
| 4,326,632 | A * | 4/1982 | Koob | 206/389 |
| 4,711,067 | A * | 12/1987 | Magni | 53/439 |
| 5,297,304 | A * | 3/1994 | O'Sullivan | 5/630 |
| 5,535,467 | A * | 7/1996 | Ciske | 5/636 |
| 5,920,933 | A * | 7/1999 | Chou | 5/636 |
| 6,021,890 | A * | 2/2000 | Focke et al. | 206/83.5 |
| 6,318,555 | B1 * | 11/2001 | Kuske et al. | 206/494 |
| 6,901,722 | B2 * | 6/2005 | Dextraze et al. | 53/399 |
| 6,954,957 | B2 * | 10/2005 | Metzger et al. | 5/706 |
| 7,100,780 | B1 * | 9/2006 | VanCalbergh et al. | 211/94.01 |
| 2007/0179864 | A1 * | 8/2007 | Leeds | 705/26 |

* cited by examiner

*Primary Examiner* — Mickey Yu
*Assistant Examiner* — Chun Cheung
(74) *Attorney, Agent, or Firm* — Imperium Patent Works; T. Lester Wallace; Darien K. Wallace

(57) ABSTRACT

A bedding article is compressed and rolled from two side edges to form a rolled bedding article having two rolled portions. The rolled bedding article is fitted into a rectangular prism-shaped container. The container depth is smaller than the container width or height. The depth extends in a depth dimension that is perpendicular to the roll axes of the rolled portions. Multiple containers that contain such rolled bedding articles are placed on a retail-store merchandise shelf. The shelf has a shelf depth that extends in the depth dimension. A first container is disposed on the shelf in front of the second container. The combined depth of the aligned containers is made to be approximately the same as the shelf depth in order to reduce the amount of wasted shelf space in the retail store.

15 Claims, 6 Drawing Sheets

(BEDDING ARTICLE HAS A CROSS-SECTIONAL C-SHAPE SCROLL)

TOP-DOWN VIEW OF INSIDE OF BOX AND CONTENTS (BEDDING ARTICLE HAS A CROSS-SECTIONAL C-SHAPE SCROLL)

(BEDDING ARTICLE HAS A CROSS-SECTIONAL M-SHAPE SCROLL)

(BEDDING ARTICLE HAS A CROSS-SECTIONAL S-SHAPE SCROLL)

ROLLED MEMORY FOAM BEDDING ARTICLE HAVING A PLURALITY OF ROLL PORTIONS

CROSS REFERENCE TO RELATED APPLICATIONS

This application is based on and hereby claims the benefit under 35 U.S.C. §119 from Chinese Patent Application No. 200610035156.9, filed on Apr. 19, 2006, in China, the contents of which are hereby incorporated by reference. This application is a continuation of Chinese Application No. 200610035156.9. This application also claims priority under 35 U.S.C. §119 from U.S. Provisional Application No. 60/903,204, entitled "Rolled Memory Foam Bedding Article Having a Plurality of Roll Portions," filed on Feb. 22, 2007, the subject matter of which is incorporated herein by reference.

TECHNICAL FIELD

The described embodiments relate to memory foam articles, and more particularly to the rolling, packaging, and shelving of memory foam bedding articles.

BACKGROUND INFORMATION

Memory foam bedding articles, such as mattress toppers and mattresses, are compressible. To facilitate transportation, storage and display, such a bedding article is often rolled and compressed into a cylindrical roll. The roll is then packed into a container such as a cardboard box. The container is transported to a retail store and is then placed on a retail-store merchandise shelf to be purchased by a consumer at the retail store.

FIG. 1 (Prior Art) is a perspective view of a compressed and rolled bedding article 1. FIG. 2 (Prior Art) is a perspective view of a container 2 that contains rolled bedding article 1 of FIG. 1. As illustrated in FIG. 1 and FIG. 2, bedding article 1 is first compressed and coiled into a cylindrical roll and is then placed into container 2. The cylindrical roll has a diameter 3. Container 2 has a rectangular prism shape with a square cross-section 4. The size of square cross-section 4 is determined by diameter 3 of the cylindrical roll.

FIG. 3 is a simplified top-down view looking down into the inside of container 2. Due to the circular cross-sectional shape of the rolled bedding article 1 in container 2, there is void space 5 inside container 2. The volume of container 2 is larger than the volume of rolled bedding article 1 due to void space 5.

FIG. 4 is a perspective view showing multiple containers 2, 7 and 8 on a retailer-store merchandise shelf 6. The front panels of the containers bear graphics including branding and labeling and advertising. The containers are arranged on shelf 6 such that the front panels of the containers are visible to prospective purchasers at the retail store.

SUMMARY

A bedding article is compressed and rolled from two side edges to form two rolled portions. The resulting rolled bedding article has a shape that approximates that of a rectangular prism. The bedding article may, for example, be a memory foam mattress or a memory foam mattress topper. The rolled bedding article is then fitted into a rectangular prism-shaped container such that little void space is left inside the container.

The container may, for example, be a cardboard box. The container may also be a vinyl bag, or a transparent bag with a zipper, or may be another suitable container. The rectangular prism-shaped container has a height, a width, and a depth. The depth is smaller than the width and is also smaller than the height. The depth extends in a depth dimension that is perpendicular to the roll axes of the two rolled portions.

In one novel aspect, multiple such containers that contain rolled bedding articles as described above are placed on a retail-store merchandise shelf to be purchased by a consumer. The shelf has a shelf depth that extends a depth dimension. The containers are placed on the shelf such that a first container is disposed on the shelf in front of the second container. A back panel of the first container abuts a front panel of the second container. The two containers are aligned in the depth dimension without exceeding the shelf depth. The combined depths of the aligned containers in the depth dimension is made to be approximately the same as the shelf depth in order to reduce the amount of wasted shelf space in the retail store.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 5:
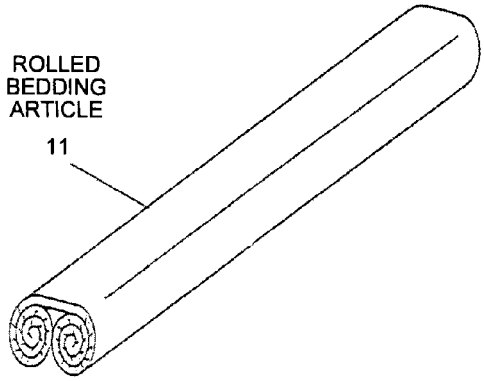
FIG. 5-6 are perspective views of a novel rolled bedding article and a rectangular prism-shaped container that contains the rolled bedding article in accordance with one novel aspect.

FIG. 5 is a perspective view of a compressed and rolled bedding article 11 in accordance with one novel aspect. In the specific example of FIG. 5, the compressed and rolled bedding article 11 is a rolled memory foam mattress topper. A mattress "topper" is sometimes called an "overlay". Rolled bedding article 11 can also be a rolled memory foam mattress or another rolled bedding article made from memory foam material.

Figure 6:
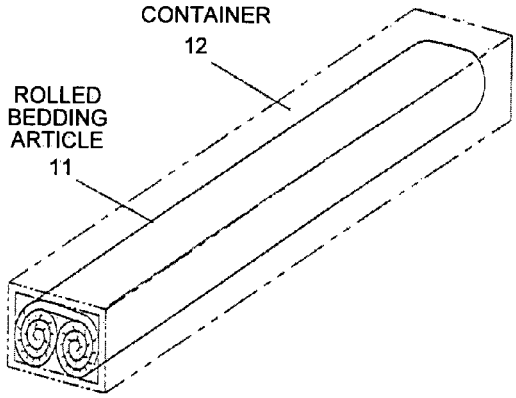

FIG. 6 is a perspective view of a container 12 that contains rolled bedding article 11 of FIG. 5. In the specific example of FIG. 6, container 12 is a cardboard box having a rectangular prism shape. Container 12 can also be a vinyl bag or a transparent bag having a zipper. Such vinyl bags and transparent bags are of the type commonly used to package bedding products such as comforters. Such vinyl bags and transparent bags, when properly filled, assume a substantially rectangular prism shape that accommodates stacking in a similar way to how a rectangular prism-shaped box would be stacked.

Figure 7:
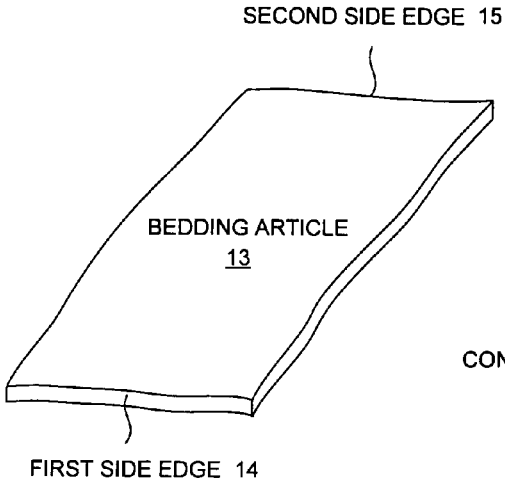
FIG. 7 is a perspective view of a bedding article prior to rolling.

FIG. 7 is a perspective view of an unpackaged bedding article 13 prior to rolling. Bedding article 13 has a first side edge 14 and a second side edge 15. The two side edges extend parallel to one another on opposite sides of bedding article 13. The bedding article may, in some embodiments, be folded in half prior to rolling.

Figure 8:
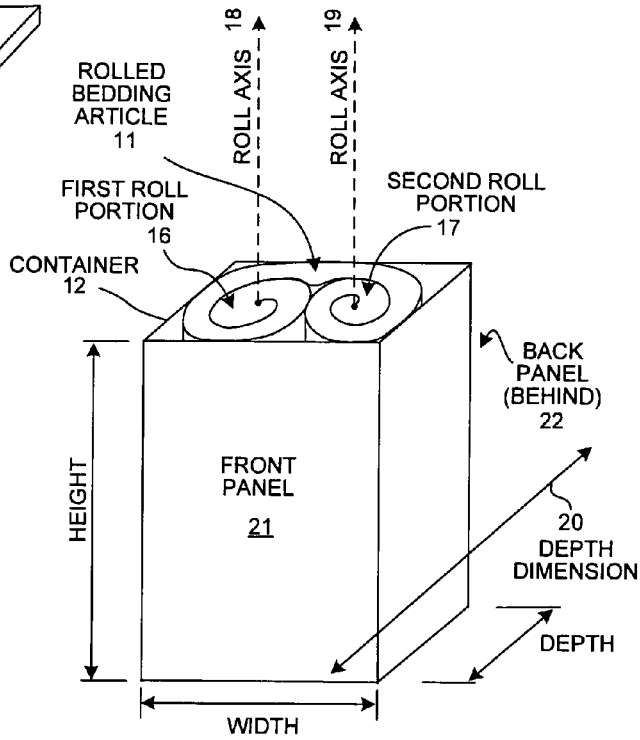
FIG. 8 illustrates a method of packaging the bedding article of FIG. 7 into a container.

FIG. 8 is a perspective view that shows how bedding article 13 of FIG. 7, after having been rolled into the rolled bedding article 11, is disposed into container 12 in accordance with one novel aspect. Rolled bedding article 11 has a scroll-shape. Rolled bedding article 11 has a first rolled portion 16 and a second rolled portion 17. First rolled portion 16 is rolled about a first roll axis 18. Second rolled portion 17 is rolled about a second roll axis 19. One of the two roll portions is rolled about its axis in a clockwise direction whereas the other of the two roll portions is rolled about its axis in a counter-clockwise direction such that the resulting rolled bedding article 11, when viewed in cross-section, has what is referred to here as a "C-shape." Container 12 has a height, a width, and a depth as illustrated. Container 12 also has a front panel 21 and a back panel 22. The depth of container 12 extends in a depth dimension 20 that extends perpendicularly to the plane of the front panel 21.

In an assembly method, bedding article 13 of FIG. 7 is first flattened and compressed, and is optionally folded in half. The resulting bedding article has the general form illustrated in FIG. 7. First side edge 14 is then hand rolled and compressed against a rigid work surface so that it is rolled toward the center of bedding article 13 to form first rolled portion 16. Second side edge 15 is also hand rolled in similar fashion toward the center of bedding article 13 to form second rolled portion 17. First rolled portion 16 and second rolled portion 17 abut one another and together form rolled bedding article 11. During the rolling process, bedding article 13 is further compressed in volume. First and second rolled portions 16 and 17 are then taped together or are otherwise secured such that rolled bedding article 11 stays in its C-shaped scroll form. The taped C-shaped scroll bedding article 11 is placed into container 12. As illustrated in FIG. 8, roll axes 18 and 19 extend in the long dimension of container 12. Because of the large size of bedding article 13, the height of container 12 is usually larger than the width and the depth. Advantageously, container 12 of FIG. 8 does not have a square cross-section as compared to container 2 of FIG. 4 when viewed from a top-down perspective, because rolled bedding article 11 is not a simple single cylindrical roll. Instead, container 12 of FIG. 8 has a rectangular cross-section when viewed from the top-down perspective, and the width is larger than the depth. Therefore, front panel 21 of container 12 has a larger area as compared to the top panel or the side panel of container 12. Front panel 21 bears lettering and graphics that also defines the orientation of container 12. The larger front panel is advantageous because it allows more area for lettering and advertising.

Figure 9:
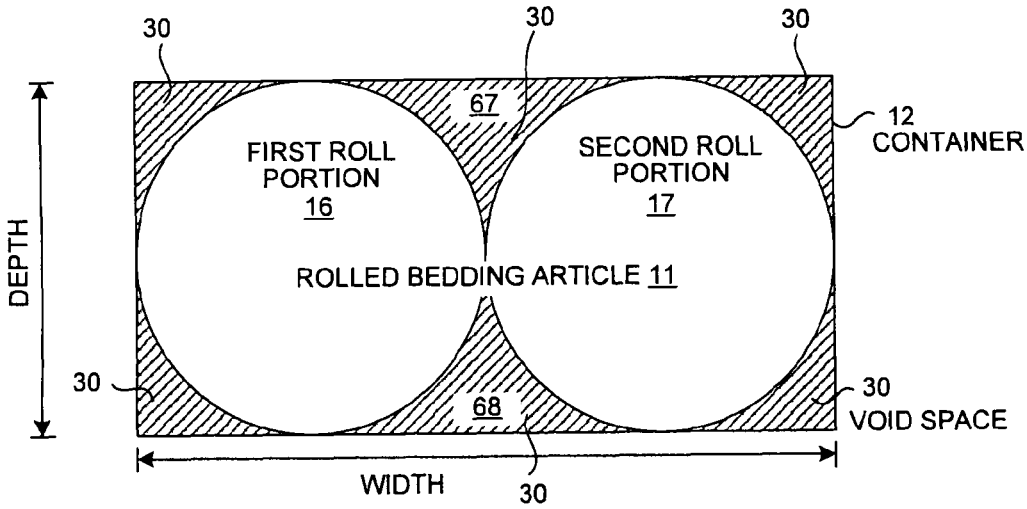
FIG. 9 is a simplified top-down view of the inside of a container and its contents.

FIG. 9 is a simplified top-down view of the inside of container 12 in an idealized example that assumes that the bedding article is rolled with a standard amount of compression force and that the cross-sectional shapes of roll portions 16 and 17 are circles. Due to the arc surface of the cylindrical rolls, there is void space 30 that is not utilized. Void space 30 is comparable to void space 5 of FIG. 3. There is significant void space 5 in volumes 67 and 68 along the inside walls of container 12 between the two rolls.

Figure 3:
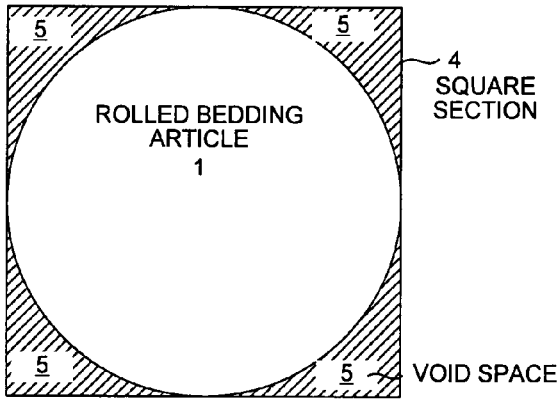
(PRIOR ART) FIG. 3
FIG. 3 (Prior Art) is a top-down view of inside of container and contents of FIG. 2.
Figure 10:
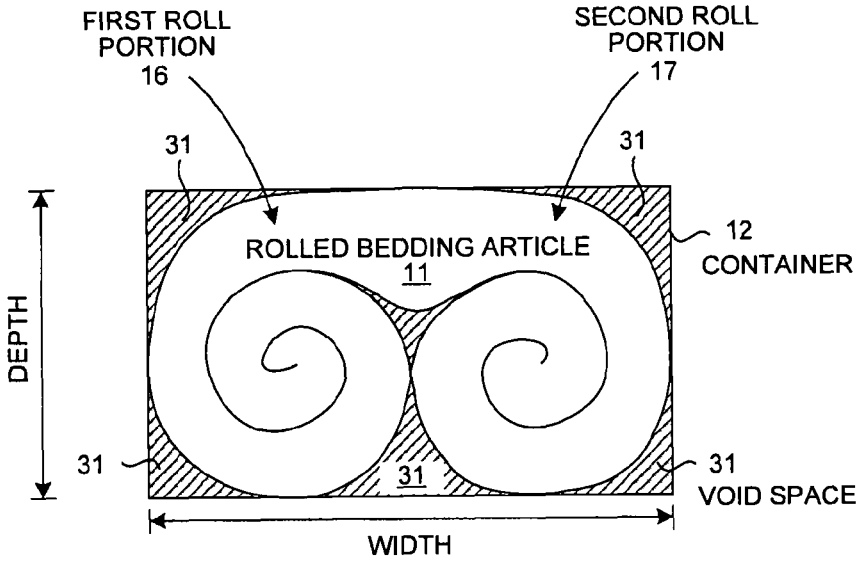
FIG. 10 is a perspective view of a bedding article that has a cross-sectional C-shape.

FIG. 10 is a cross-sectional view of novel rolled bedding article 11 disposed inside novel container 12. Rolled bedding article 11 has a cross-sectional C-shape. During the rolling process, bedding article 13 is further compressed to form a smaller diameter first rolled potion 16 and a smaller diameter second rolled portion 17 as compared to FIG. 9. Although the rolled bedding article 1 of FIG. 3 is also compressed during the rolling process, the rolled bedding article 11 of FIG. 10 is compressed more because compression force is more efficiently and easily transferred into the memory foam material of smaller diameter rolls as compared to larger diameter rolls.

Figure 2:
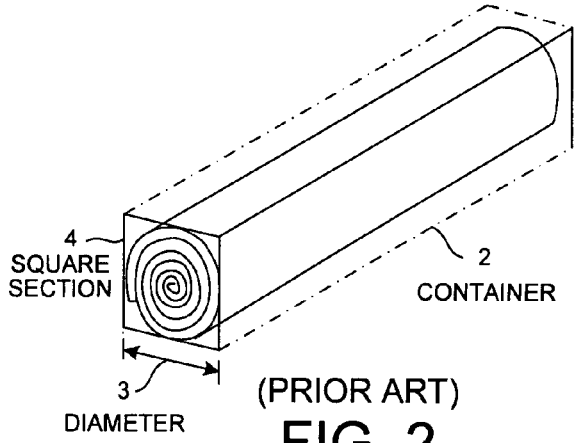
(PRIOR ART) FIG. 2

Furthermore, as illustrated in FIG. 10, memory foam material extends along the inside upper wall of container 12, thereby effectively filling the volume between roll portion 16 and roll portion 17 along the upper side wall of container 12. As compared to the example of FIG. 9, more of the void space 30 is filled. Moreover, some of the length of the bedding article is consumed in the filling of volume 67 and as a consequence less bedding material needs to be rolled in roll portions 16 and 17. The diameters of roll portions 16 and 17 are therefore made smaller due to the C-shaped scroll. The further reduction in roll diameter allows the first and second roll portions 16 and 17 to be more compressed during the hand-rolling process than they would be were they to have larger diameters. The C-shape scroll fits relatively tightly into the confines of container 12. Therefore, this rolling and packaging method substantially reduces the volume of rolled bedding article 11. Due to there being less void space, the size of container 12 is reduced. The depth of container 12 is substantially reduced as compared to diameter 3 of container 2 in FIG. 2. The width of container 12 is not, however, substantially increased. In one advantageous aspect, the cross-sectional shape of container 12 is a rectangle and not a square.

Figure 11:
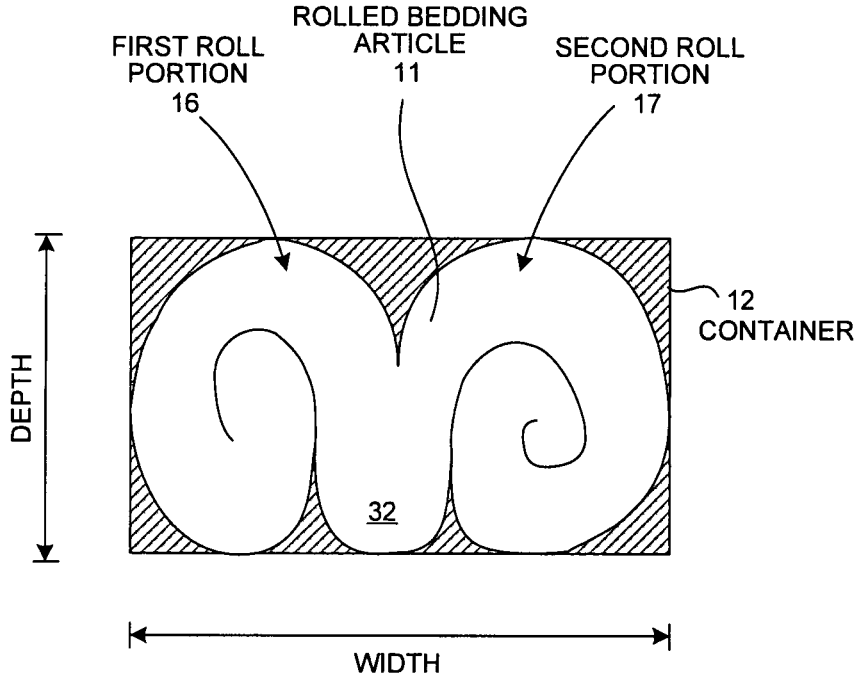
FIG. 11 is a perspective view of a bedding article that has a cross-sectional M-shape.

FIG. 11 is a perspective view of another example of rolled bedding article 11. This rolled shape is said to have a cross-sectional "M-shape". First roll portion 16 is rolled in a counter-clockwise direction, and second roll portion 17 is rolled in a clockwise direction as in the case of FIG. 10, but in the example of FIG. 11 there is an intervening fold 32 in the rolled bedding article. This fold consumed bedding material, and reduces the diameters of the two roll portions 16 and 17.

Figure 12:
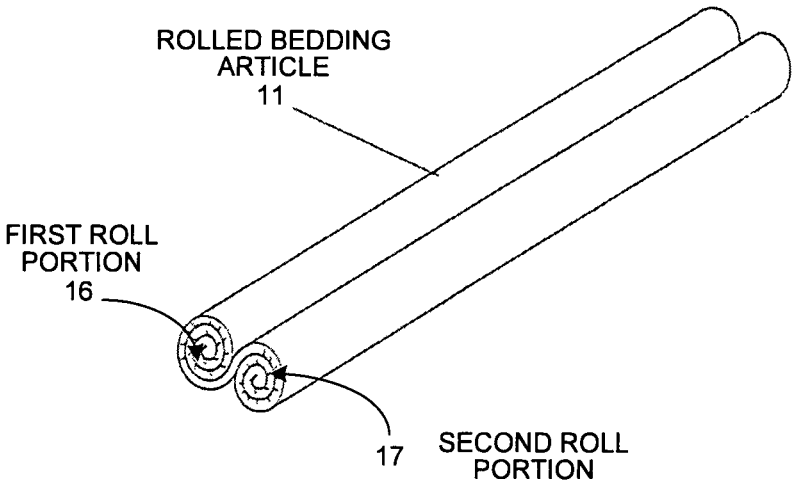
FIG. 12 is a perspective view of a bedding article that has a cross-sectional S-shape.

FIG. 12 is a perspective view of yet another example of rolled bedding article 11. This rolled shape is said to have a cross-sectional "S-shape."

Figure 13:
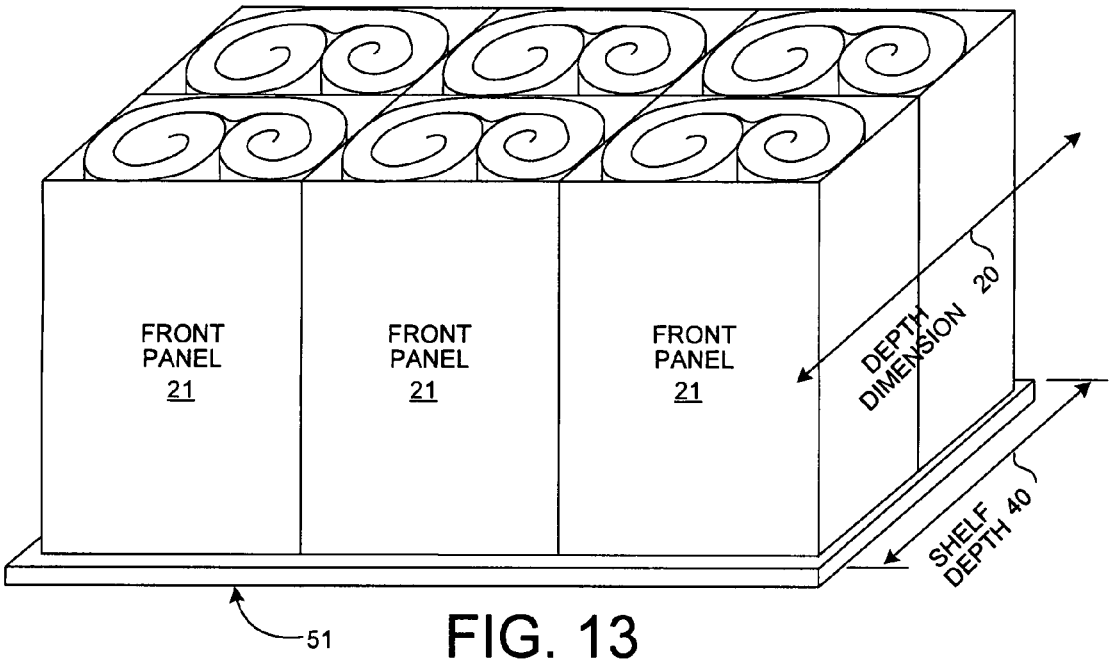
FIG. 13 is a perspective view of boxes that contain rolled bedding articles in accordance with one novel aspect. The boxes are disposed in two rows on a merchandise shelf such that one row of boxes is in front of the other row of boxes.

FIG. 13 is a perspective view of six identical containers that contain rolled bedding articles in accordance with one novel aspect. The containers are disposed on a retail-store merchandise shelf 51. The top panels of the containers are not illustrated in order to reveal the orientation of the C-shaped rolled bedding articles inside the containers.

Figure 14:
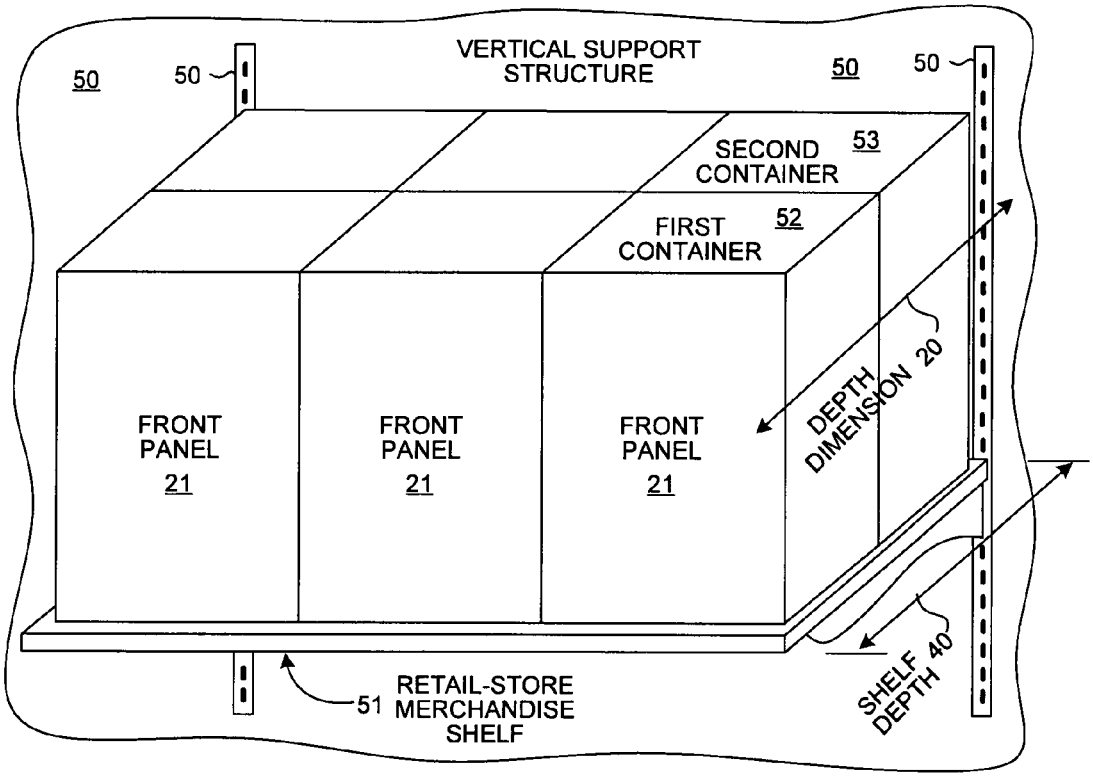
FIG. 14 is a perspective view of the boxes of FIG. 13.

FIG. 14 is a perspective view of the containers of FIG. 13. Shelf 51 has a shelf depth 40. Shelf 51 is supported by a vertical support structure 50. In the illustration, vertical support structure 50 is a wall such as a vertical building wall or wall panel. The vertical support structure 50 also includes metal shelf support rails that have slots for accommodating horizontally extending shelf supports.

Figure 1:
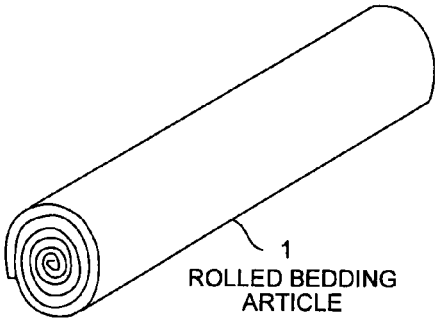
(PRIOR ART) FIG. 1
FIGS. 1-2 (Prior Art) are perspective views of a conventional rolled bedding article and a container that contains the rolled bedding article.

Shelf depth 40 extends in a depth dimension 20 as illustrated. All the containers, including a first container 52 and a second container 53, are disposed on shelf 51. Because the depth of first container 52 and the depth of second container 53 are reduced (as compared to the case of the same bedding article being rolled into a single cylindrical roll as in FIG. 1), two containers (containers 52 and 53) can be disposed on shelf 51 such that one of the containers 52 is disposed in front of the other container 53. Two containers are disposed on shelf 51 along depth dimension 20 without exceeding shelf depth 40. The two containers 52 and 53 are disposed face-to-face on shelf 51 such that the back panel of container 52 abuts the front panel of container 53. In addition, a retail customer confronting retail-store merchandise shelf 51 will be able to perceive front panel 21 of first container 52 in order to make purchase decision.

Figure 4:
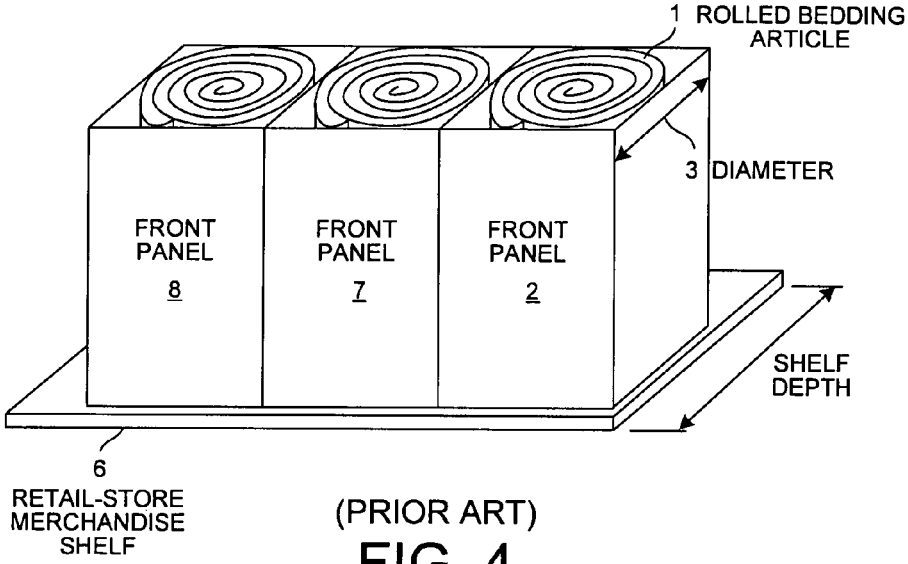
(PRIOR ART) FIG. 4
FIG. 4 (Prior Art) is a perspective view of multiple containers that contain rolled bedding articles. The multiple containers are disposed on a retail-store merchandise shelf in conventional fashion.

In one advantageous aspect, a very large chain of retail stores has shelves of a standard depth of twenty-two inches. If the bedding article were rolled in the conventional single-roll fashion as illustrated in FIG. 4, then the diameter of the single roll would result in the depth of the container being approximately eighteen inches. The difference between the shelf depth and the container depth would be approximately four inches. There would not be adequate shelf depth to accommodate containers being placed on the shelf, one in front of the other. Four inches of shelf depth would therefore be wasted and is unusable. In accordance with one novel aspect of the containers illustrated in FIG. 14, however, container depth is reduced to ten inches. The standard shelf, that has a depth of twenty-two inches, can therefore accommodate containers being placed one in front of the other—Only two inches of shelf depth space is wasted. More merchandise can therefore be placed on the standard sized shelf. Being able to place more merchandise on the standard shelf has significant commercial benefit to the retail-store. The bedding article manufacturer can vary the scroll-shape to adjust the dimensions of containers that contain different types, and thicknesses, and dimensions of bedding articles. If, for example, a smaller depth container dimension is desired, then the bedding article can be rolled with the M-shape of FIG. 11 that has fold 32 as opposed to the C-shape of FIG. 10. If desired, container depth can be further reduced by employing a roll shape that has two or more folds.

Figure 15:
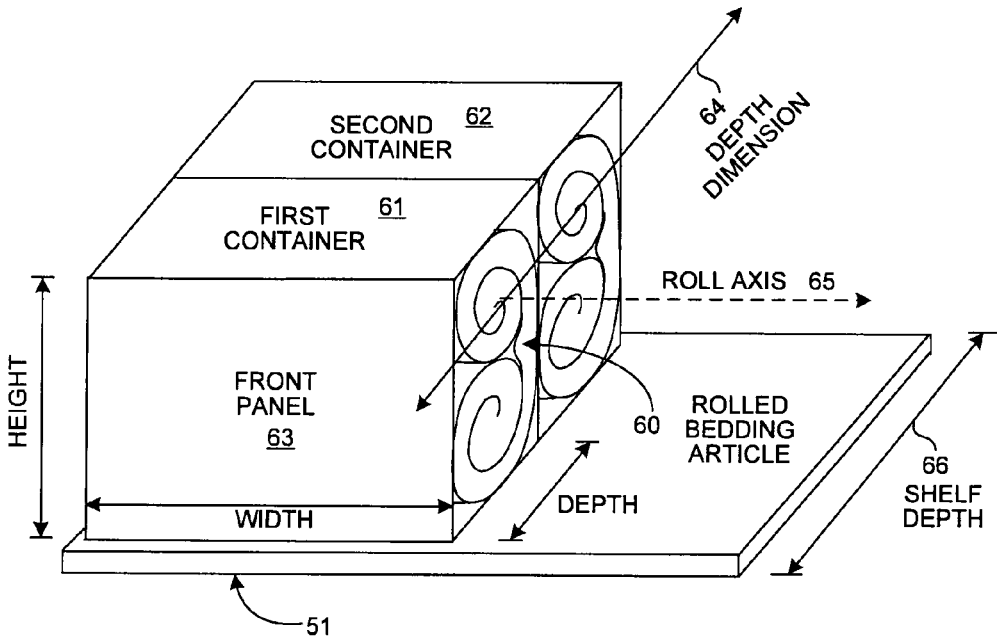
FIG. 15 is a perspective view of another example of boxes that contain rolled bedding articles. The boxes are disposed in two rows on a merchandise shelf such that one row of boxes is in front of the other row of boxes.
Figure 16:
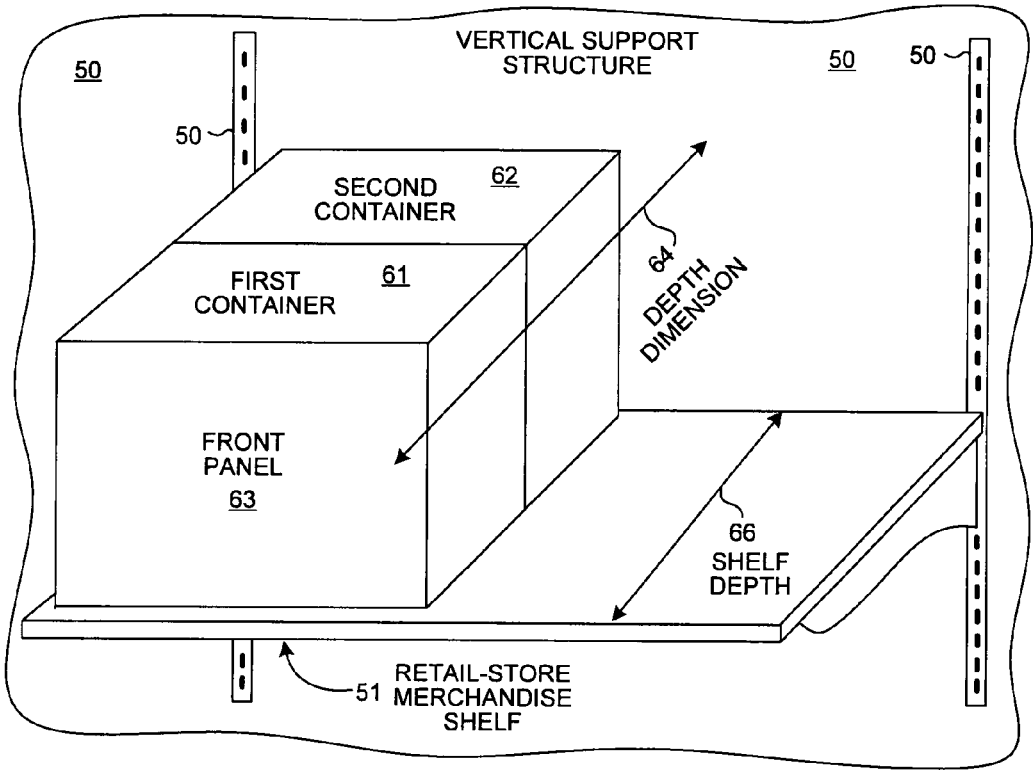
FIG. 16 is a perspective view of the boxes of FIG. 15.

FIGS. 15 and 16 illustrate another example of disposing containers that contain rolled bedding articles on retail-store merchandise shelf 51. As illustrated in FIG. 15, rolled bedding article 60 is placed into first container 61 such that roll axis 65 extends in the horizontal dimension but is perpendicular to depth dimension 64 of shelf 51. Under this packaging method, the depth of first container 61 is smaller than the height and the width. As illustrated in FIG. 16, the first container 61 is disposed on shelf 51 in front of second container 62 such that the combined dimensions of the containers in dimension 64 do not exceed the depth 66 of shelf 51. Similarly, a retail consumer confronting retail-store merchandise shelf 51 will be able to perceive front panel 63 of first container 61 in order to make purchase decision.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus comprising:

a rolled bedding article that has a first roll portion and a second roll portion, wherein the first roll portion has a first roll axis and the second roll portion has a second roll axis, wherein the first roll axis is separated from the second roll axis, and wherein the rolled bedding article is taken from the group consisting of:

a rolled memory foam mattress, and a rolled memory foam mattress topper; and a container that contains the rolled bedding article, wherein the container has a width, a depth and a height, wherein the depth extends in a depth dimension, and wherein the depth is smaller than the width and is smaller than the height.

2. The apparatus of claim 1, wherein the first roll axis is perpendicular to the depth dimension.

3. The apparatus of claim 2, wherein the container has a front panel, wherein the front panel bears lettering that defines which one of a plurality of dimensions of the container is the height dimension.

4. The apparatus of claim 1, wherein the container is taken from the group consisting of: a box, a vinyl bag, and a transparent bag having a zipper.

5. The apparatus of claim 1, wherein the rolled bedding article has a cross-sectional M-shape.

6. The apparatus of claim 1, wherein the rolled bedding article has a cross-sectional C-shape.

7. The apparatus of claim 1, wherein the rolled bedding article has a cross-sectional S-shape.

8. The apparatus of claim 1, wherein the first roll portion includes a first side edge of the rolled bedding article, wherein the second roll portion includes a second side edge of the rolled bedding article, and wherein the first and second side edges extend parallel to one another.

9. A method, comprising:

(a) rolling a bedding article to obtain a rolled bedding article with a first roll portion and a second roll portion, wherein the first roll portion has a first roll axis and the second roll portion has a second roll axis, wherein the first roll axis is separated from the second roll axis, and wherein the bedding article is taken from the group consisting of: a memory foam mattress, and a memory foam mattress topper; and (b) placing the rolled bedding article into a container, wherein the container has a width, a depth and a height, wherein the depth extends in a depth dimension and is smaller than the width and is also smaller than the height, and wherein the first roll axis is perpendicular to the depth dimension.

10. The method of claim 9, wherein the container taken from the group consisting of: a box, a vinyl bag, a transparent bag having a zipper.

11. The method of claim 9, wherein the rolling involves:

rolling a first side edge of the bedding article to form the first roll portion; and rolling a second side edge of the bedding article to form the second roll portion.

12. The method of claim 9, wherein the rolled bedding article has a cross-sectional C-shape.

13. The method of claim 9, wherein the rolled bedding article has a cross-sectional S-shape.

14. The method of claim 9, wherein the rolled bedding article has a cross-sectional M-shape.

15. The method of claim 9, wherein the rolling of (a) is a hand-rolling operation.

* * * * *